US005445558A

United States Patent [19]

Hutchins

[11] Patent Number: 5,445,558

[45] Date of Patent: Aug. 29, 1995

[54] WET SANDER

[75] Inventor: Donald H. Hutchins, Sierra Madre, Calif.

[73] Assignee: Hutchins Manufacturing Company, Pasadena, Calif.

[21] Appl. No.: 277,758

[22] Filed: Jul. 20, 1994

[51] Int. Cl.[6] ..... B24B 23/02

[52] U.S. Cl. ..... 451/344; 451/357; 451/450; 451/456

[58] Field of Search ..... 451/344, 357, 359, 449, 451/450, 451, 455, 456

[56] References Cited

U.S. PATENT DOCUMENTS

| | | | |
|---|---|---|---|
| 3,110,993 | 11/1963 | Grage . | |
| 3,785,092 | 1/1974 | Hutchins . | |
| 3,815,292 | 6/1974 | Hutchins . | |
| 3,824,745 | 7/1974 | Hutchins . | |
| 4,022,182 | 5/1977 | Lenkevich | 451/357 |
| 4,102,084 | 7/1978 | Bloomquist . | |
| 4,129,966 | 12/1978 | Smart et al. . | |
| 4,145,848 | 3/1979 | Hutchins . | |
| 4,490,948 | 1/1985 | Hanstein et al. . | |
| 4,660,329 | 4/1987 | Hutchins . | |
| 4,671,019 | 6/1987 | Hutchins . | |
| 4,671,020 | 6/1987 | Hutchins . | |
| 4,811,526 | 3/1989 | Roestenberg | 451/449 |
| 5,022,190 | 6/1991 | Hutchins . | |

FOREIGN PATENT DOCUMENTS 58-59765A of 1983 Japan .

OTHER PUBLICATIONS

Pp. 24 and 25 of Feb. 1994 issue of Chilton's Automatic Body Repair News.

Leaflet entitled Kovax Orbital Sander Part No. 910-8735.

*Primary Examiner*—Maurina T. Rachuba

*Attorney, Agent, or Firm*—William P. Green

[57] ABSTRACT

A wet sanding tool including a tool body carrying a motor which drives a head carrying a sheet of sandpaper or other abrading element, with the tool being adapted to deliver water to the work surface during a sanding operation, and preferably also to conduct a suction induced flow of air, water and abraded particles from the work surface. The tool desirably includes a shroud disposed about the power driven sanding head for confining the flow of air, water and abraded particles from the work surface, and having a seal element carried by the periphery of the shroud and engageable with the work surface about the head. Water may be delivered to the work surface through a space within the interior of the shroud and through passages in the driven head. Two seal elements between the shroud and head may isolate the flow of incoming water from the outgoing flow of air, water and abraded particles.

19 Claims, 3 Drawing Sheets

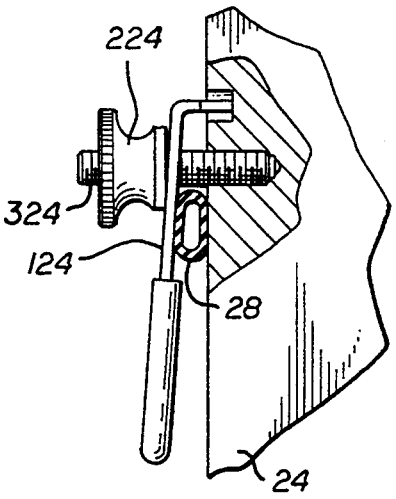
FIG. 4
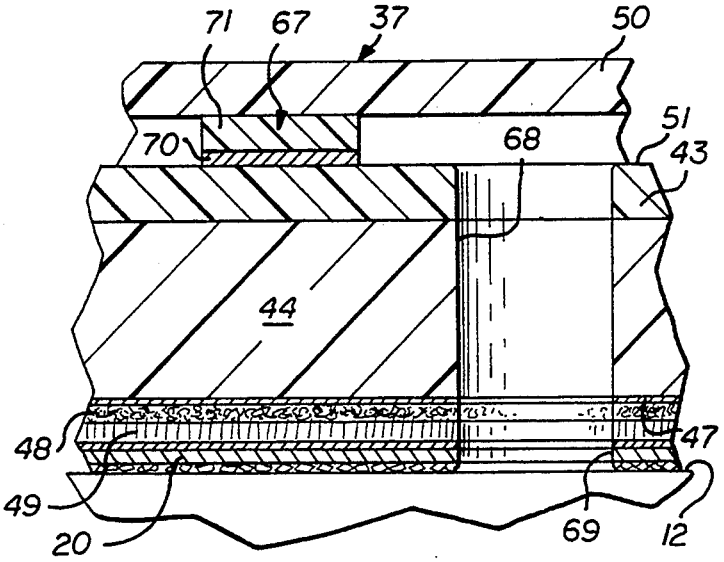
FIG. 2A
FIG. 5
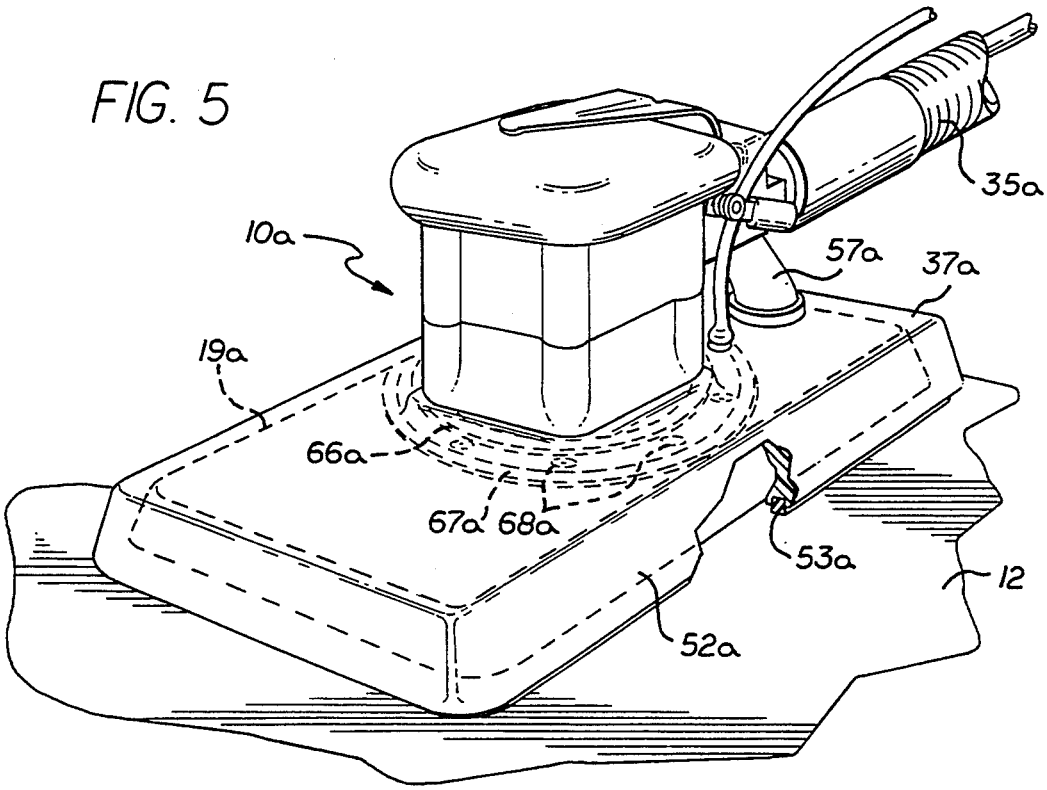

WET SANDER

This invention relates to portable power driven sanding tools for use in a wet sanding operation.

BACKGROUND OF THE INVENTION

The effectiveness with which a powered sander abrades a work surface can in many instances be enhanced by continually feeding water to that surface, to cool and lubricate the surface and the sandpaper and wash away particles abraded from the surface. A tool designed for such wet sanding is disclosed in U.S. Pat. No. 5,022,190 issued Jun. 11, 1991 to Mr. Alma A. Hutchins on "Wet Sanding Tool". The tool shown in that patent includes a power driven sanding head which carries a sheet of sandpaper and which contains passages delivering water through the interior of the pad and through openings in the sandpaper sheet directly onto the work surface at the location of the abrading operation.

SUMMARY OF THE INVENTION

One purpose of the invention is to provide a wet sanding tool which is of the above discussed general type, but which, in addition to delivering water to the work surface, also functions at the same time to continually remove the water and abraded particles by suction from the surface. The tool preferably includes a shroud which extends about the sanding head, and which encloses a confined flow of air, water and abraded particles from the work surface. The shroud may carry a seal element engageable with the work surface about the periphery of the sanding head, to prevent escape of water from the shroud.

Another feature of the invention resides in an, improved arrangement for delivering incoming water to the sanding head of a wet sanding tool. This feature may be used in a tool in which the spent water is removed by suction as discussed above, or in some instances may be employed in tools not having that water removal capability. The incoming water is preferably directed into a confined space between the sanding head and a shroud attached to the body of the tool, which space communicates with passages in the head leading to the work surface. Seal means between the head and shroud confine the flow of water to the head, and in the case of an orbital drive arrangement are preferably generally annular about the axis of the tool, to enable free rotation of the head relative to its orbital drive mechanism and in addition to its orbital movement while effectively feeding water to the head. These seal means may include two seal rings between the shroud and the sanding head defining an annular water delivery space communicating with and feeding water to the passages in the head. When the tool is of the type in which used water is drawn by suction from the work surface, the outer of the two seal rings may also function to isolate the incoming water from the flow of air, water and particles leaving the surface.

BRIEF DESCRIPTION OF THE DRAWINGS

The above and other features and objects of the invention will be better understood from the following detailed description of the typical embodiments illustrated in the accompanying drawings, in which:

FIG. 2A is a further enlarged fragmentary vertical section taken with circle designated by the letter "A" in FIG. 2;

FIG. 4 fragmentary section taken on line 4—4 of FIG. 1;

FIG. 5 is a perspective view of a variational form of the invention; and

DESCRIPTION OF THE PREFERRED EMBODIMENTS

Figure 1:
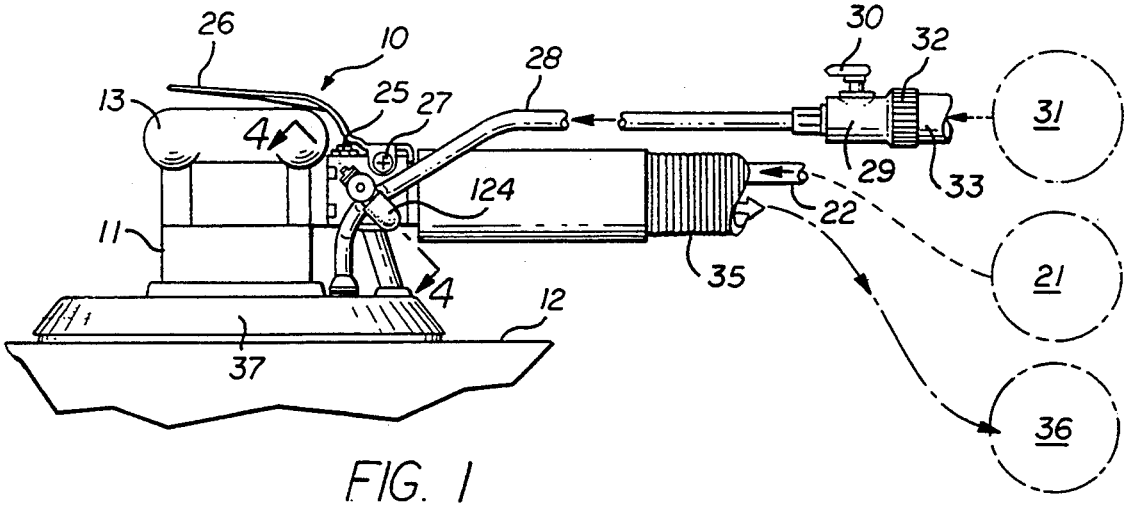
FIG. 1 is a side elevational view of a first form of portable sander constructed in accordance with the invention.
Figure 3:
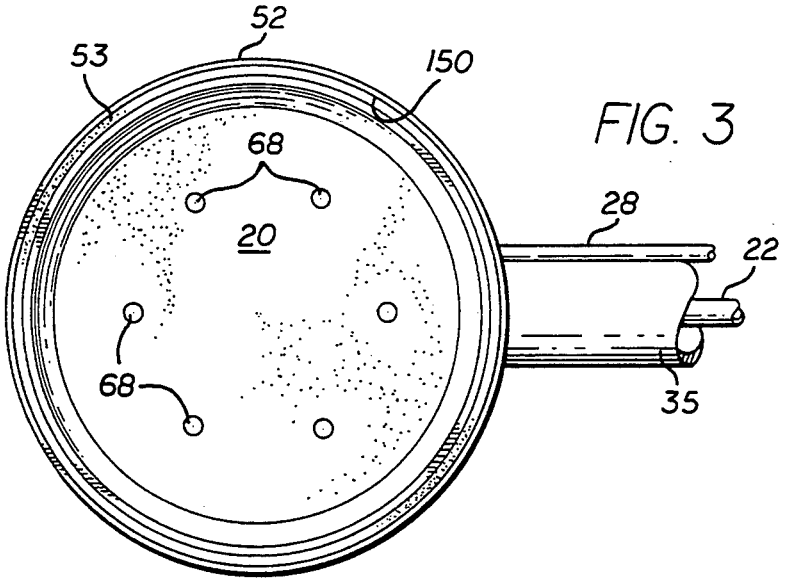
FIG. 3 is a reduced bottom plan view taken on line 3—3 of FIG. 2.

The tool 10 shown in FIGS. 1 to 4 is an orbital sander having a body structure 11 shaped as a handle which is grasped by a user to hold the tool and move it along a typically horizontal work surface 12 to sand or polish that surface. The upper portion of body structure 11 may be covered at its top and sides by a cushion 13 of rubber or other resiliently deformable material by which the tool is held. An air driven motor 14 is contained within body 11 and drives a carrier part 15 (see FIG. 2) rotatively about a main vertical axis 16. A part 17 at the underside of carrier part 15 is connected to the carrier for rotation relative thereto about a second vertical axis 18 which is parallel to axis 16 but offset slightly therefrom. Elements 15 and 17 are thus portions of an orbital drive mechanism which moves an abrading pad or head 19 and a carried sheet of sandpaper 20 orbitally about axis 16 of the motor to sand surface 12. Air is supplied to motor 14 from a source 21 of compressed air through a line 22 and an inlet passage 23 formed in a block 24 attached to the rear of handle body 11. The delivery of air to the motor is controlled manually by a valve 25 in block 24, which valve is normally closed and is adapted to be opened by downward movement of an actuating handle 26 attached pivotally to block 24 at 27.

Water is supplied to the device by a flexible water inlet line 28, which delivers the water to the work surface through openings 68 in the sanding pad or head. The delivery of water to line 28 may be controlled by a water inlet valve 29 adapted to be opened by manual actuation of an operating element 30. Valve 29 may be connected to a source 31 of water under pressure, as by threaded attachment of a conventional hose fitting 32 to a water line 33. The water line 28 may have a portion extending along a side of block 24, and retained against the block by a clamp element 124 tightenable toward the block by a nut 224 connected threadedly to a screw 324 projecting from the block. The rate of water flow to head 19 can be varied by manually adjusting nut 224 to variably constrict water tube 28.

Air discharged from motor 14 flows through an aspirator 34 formed in block 24, and acts to create a subatmospheric pressure in the aspirator serving to draw air, water and abraded particles by suction from the work surface for delivery through a hose 35 to a collection point or container represented at 36. This flow of air, water and abraded particles is confined against escape from the tool by a shroud 37 attached to the lower portion of the body 11 of the tool.

The rotary connection between carrier part 15 and part 17 is formed by providing within a recess 38 in the underside of part 15 two ball bearings 39 whose outer races are tight friction fits within part 15 and whose inner races contain an upwardly projecting cylindrical spindle portion 40 of part 17. This spindle 40 is a tight friction fit within the inner races of bearings 39. The bearings 39 and the recess 38 in part 15 are centered about the vertical axis 18, which as mentioned is offset slightly from but parallel to axis 16 of the motor, to thus mount part 17 for rotary movement about axis 18 relative to part 15, and for orbital movement about main axis 16 of the tool.

A counterweight 75 is attached to the underside of part 15, vertically between that part and element 17. The counterweight may be formed to have a horizontal bottom wall 76 which is circular about axis 16, and a semicircular flange 77 partially encircling one side of cylindrical part 15 and dimensioned to counterblance the eccentricity of element 17, bearings 39, pad 19 and the connected parts with respect to axis 16. All of the parts turning about axis 16 are thus balanced about that axis. The lower circular horizontal portion 76 of the counterweight may be rigidly attached to part 15, by two or more screws 78, with a generally annular gasket 79 received vertically between portion 76 of the counterweight and part 15 to prevent the flow of water therebetween. A seal ring 80 may be received about a lower cylindrical portion of spindle 40 and annularly engage the spindle and an inner cylindrical surface in portion 76 of the counterweight, to prevent flow of water upwardly between the spindle and the counterweight toward the bearings. Thus the gasket 79 and seal ring 80 act together to protect the bearings from contact with the water.

The sandpaper carrying pad or head 19 is attached to the underside of part 17 for orbital movement therewith about axis 16. The pad is circular about axis 18, and is detachably connectable to part 17 by a threaded bolt 41 projecting upwardly from head 19 and connectable into a threaded bore 42 formed in part 17 and centered about axis 18. The pad may include an upper essentially rigid backing plate 43 typically formed of an appropriate resinous plastic material, and a resiliently deformable circular cushion 44 of rubber or resinous plastic material bonded to the underside of backing plate 43. Bolt 41 may be attached rigidly to backing plate 43 in any appropriate manner, as by forming the bolt to have an upper circular flange 45 engaging the upper side of plate 43, and a rivet head 46 which is upset to engage the underside of the plate. Sandpaper sheet 20 may be connected detachably to the horizontal undersurface 47 of the pad in any convenient manner, as by providing the undersurface 47 with a sheet of velcro material represented at 48, engageable with a mating velcro sheet 49 on the upper side of the sandpaper sheet. Alternatively, the sandpaper may be adhered by a releasable adhesive, or by any other conventional type of attachment.

Shroud 37 is circular about axis 16, having an upper horizontally extending wall 50 extending parallel to and spaced above an upper horizontal surface 51 of the backing plate 43 of pad 19. At its periphery, shroud 37 has an outer wall 52 which projects downwardly from the edge of top wall 50 toward work surface 12, and which is centered about vertical axis 16 of the motor. The lower edge of outer wall 52 of the shroud carries an annular seal element 53, whose undersurface lies in a horizontal plane perpendicular to axis 16 and aligned horizontally with the undersurface of sandpaper sheet 20, to contact the work surface 12 in sealing relation entirely about the sandpaper sheet and head 19. Seal element 3 may be formed of a felt type sealing material, or any other appropriate sealing material capable of preventing the escape of water, air or abraded particles past the seal, and capable of sliding to different locations on the work surface as the sanding operation progresses. Element 53 may be attached to the peripheral wall 52 of the shroud in any suitable manner, as by partial reception of element 53 within an annular groove 150 in the shroud, with the seal element preferably being retained in the groove by a watertight adhesive.

The shroud is secured to body 11 of the tool in fixed relation relative thereto, preferably by providing the inner edge of top wall 50 of the shroud with an upwardly projecting tubular portion 54 which surrounds the lower end of a cylindrical vertical side wall 154 of body 11 and contains an annular groove 55 receiving an annular flange 56 on wall 154 in a manner interlocking the parts and forming a mechanical connection therebetween. Shroud 37 is formed of a slightly deformable material, preferably a resinous plastic material, enabling portion 54 to be stretched over flange 56, with portion 54 subsequently returning to a reduced diameter condition by the resilience of the material of the shroud to tightly grip wall 51 and remain attached thereto.

A flow of air, water and abraded particles is drawn upwardly within the shroud and about the periphery of head 19 by aspirator 34 in block 24. This flow of air, water and particles leaves the shroud through a tube 57 communicating with the interior of the shroud through an opening 58 in the top wall 50 of the shroud. A tubular projection 59 may extend upwardly from the top wall 50 of the shroud about opening 58, to receive and locate the lower end of tube 57. The upper end of the tube is connected rigidly into block 24, to deliver the air, water and particles into a passage 60 in the block, at the underside of a divider wall 61. The air discharged from motor 14 flows rightwardly within a passage 62 at the upper side of wall 61, to merge with the air, water and particle flow from the work surface beyond the right edge 63 of wall 61, and thereby attain the desired aspirator action inducing the flow of air, water and particles from the work surface as a result of the energy contained in the air discharged from the motor.

The previously mentioned water inlet line 28 may be attached to a tubular fitting 64 connected into an opening in top wall 50 of the shroud, to deliver the water through fitting 64 to an annular space 65 between two annular seal elements 66 and 67 carried by wall 50 of the shroud at its underside. The water flows downwardly from space 65 through a series of vertical openings 68 which extend through pad 19 to the work surface and are spaced apart circularly about axis 18 at a common distance from that axis. These openings 68 extend through both the top plate 43 of the pad and the resiliently deformable cushioning portion 44 of the pad. Communicating openings 69 are formed in the sandpaper sheet (and in the velcro connection sheets 48 and 49) to deliver the water directly to the work surface at the location of contact between the sandpaper and the work.

Seal rings 66 and 67 are concentric and centered about the main axis 16 of the motor, and may be secured to top wall 50 of the shroud by an appropriate adhesive or other-wise. Each of the rings 66 and 67 may include a bottom Sheet 70 of water and abrasion resistant resinous plastic sealing material and a resiliently deformable upper annular cushion portion 71 of the seal ring formed of an appropriate water resistant and watertight closed cell foam or the like giving resilience to the bottom work contacting layer 70. Ring 66 engages the upper planar surface 51 of pad 19 annularly in sealing relation at a location radially inwardly of openings 68 in the pad, and the second seal ring 67 similarly engages the upper surface 51 of the pad annularly in sealing relation at a location radially outwardly of openings 68. The water is thus effectively confined between the two seal rings, and can flow only downwardly through openings 68 to the work surface. The outer ring 67 also isolates the flow of incoming water between the rings from the flow of air, water and abraded particles drawn upwardly by the aspirator about the periphery of head 19.

In using the tool of FIGS. 1 to 4, an operator grasps body 11 by holding its upper cushion portion 13, and at the same time presses downwardly on handle 26 to actuate valve 25 for admitting air to motor 14. The motor drives part 15 rotatively about axis 16, with part 17 and head 19 and the carried sandpaper sheet rotating relative to part 15 about the second axis 18 as permitted by bearings 39, to thus drive pad 19 and the sandpaper sheet orbitally about axis 16. Water introduced into the device through water line 28 flows downwardly through the top wall of the shroud into space 65 between seal rings 66 and 67, and then downwardly to the work surface through openings 68 and 69 to lubricate and cool the work surface during the sanding operation. The water and abraded particles are drawn upwardly within the shroud at the periphery of head 19 and through tube 57 and aspirator 34 into hose 35 leading to discharge location 36. Thus, the abraded particles and water are all collected at the location 36, and are not allowed to escape from-the tool s in conventional wet sanding.

FIGS. 1 through 4 illustrate the application of the invention to an orbitally driven sanding tool with a circular non-captive head. The invention may also be applied to other types of sanders, such as for example orbital tools having captive sanding heads which are restrained against free rotation relative to the carrier part 15, and which may be rectangular or of other non-circular shapes. FIG. 5 illustrates at 10*a* a tool of this type which may be essentially the same as that of FIGS. 1 to 4 except that the sanding head 19*a* is rectangular rather than circular, and the shroud 37*a* is also rectangular and slightly larger in size than head 19*a*. The rectangular side wall 52*a* of the shroud may carry a rectangular seal element 53*a* at its lower edge, corresponding to the seal 53 of FIGS. 1 to 4, to engage the work surface 12 entirely about the periphery of the head and confine the flow of air, water and abraded particles for discharge only through tube 57*a* and an aspirator energized by a flow of exhaust air from the motor of the device corresponding to the aspirator 34 of the first form of the invention. Water is admitted to a space between two seal rings 66*a* and 67*a* corresponding to the rings 66 and 67 of the first form of the invention, for flow downwardly through apertures 68*a* in pad 19*a* and to the work surface. The pad 19*a* may be restrained against free rotation relative to the body of the device and shroud 37*a* in any convenient manner.

Figure 6:
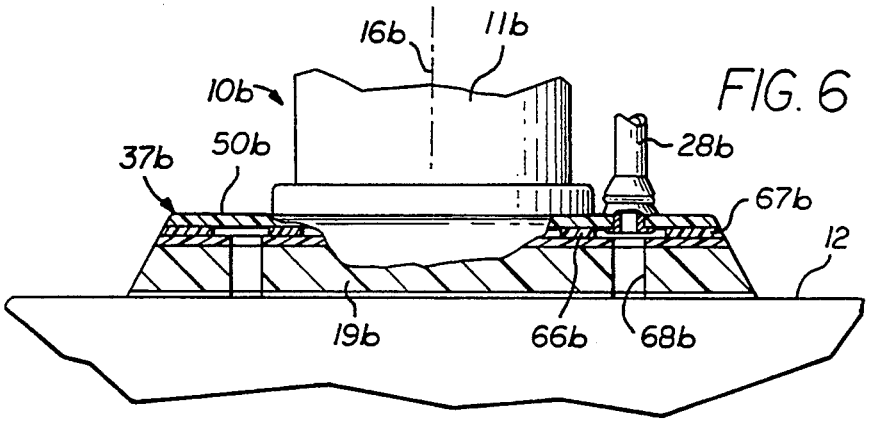
FIG. 6 fragmentary vertical section through another variational arrangement.
Figure 2:
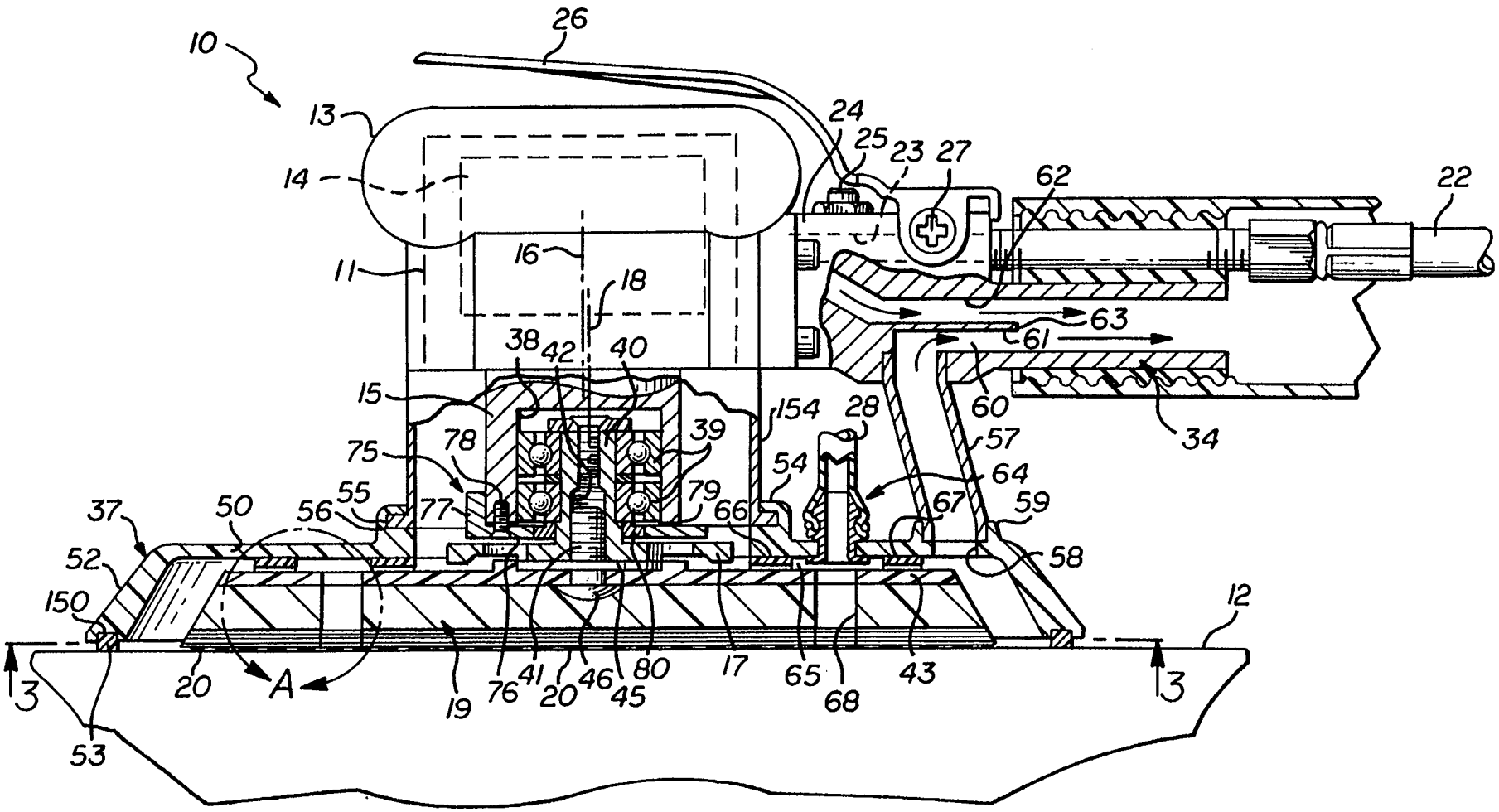
FIG. 2 is an enlarged view of the sander, partially in elevation, but with portions of the device illustrated in vertical section.

FIG. 6 shows another variational form of the invention, which includes the water feed arrangement of FIGS. 1 to 4 but not the water removal portion of the invention. The tool 10*b* of FIG. 6 may be identical to that of FIGS. 1 to 4, except for a change in the shroud and omission of the water removal tube 57 and aspirator 34 from the device. In FIG. 6, shroud 37*b* has a horizontal wall 50*b* corresponding to wall 50 of FIG. 2, but does not have the downwardly projecting peripheral wall 52 of FIG. 2. The shroud is connected to body 11*b* of the tool in the same way that shroud 37 is attached in FIG. 2. Wall 50*b* of the shroud of FIG. 6 may be externally circular about axis 16*b*, and carries at its underside two seal rings 66*b* and 67*b* corresponding to rings 66 and 67 of the first form of the invention and annularly engaging the upper horizontal surface of the circular sandpaper carrying pad 19*b*. As in the first form of the invention, water is fed from inlet line 28*b* to the space between rings 66*b* and 67*b*, and then flows downwardly through openings 68*b* in pad 19*b* to the work surface.

It is also contemplated that the invention can be applied to reciprocating sanders, in which the sanding head and carried sandpaper sheet reciprocate in a straight line relative to the body of the tool, with a typically rectangular shroud similar to that of FIG. 4 being applied about the head and contacting the work surface outwardly beyond and about the periphery of the head as in the other forms of the invention.

While certain specific embodiments of the present invention have been disclosed as typical, the invention is not limited to these particular forms, but rather is applicable broadly to all such variations as fall within the scope of the appended claims.

I claim:

1. A portable abrading or polishing tool comprising:
- a tool body to be held and manipulated by a user;
- a motor carried by said body;
- a head movable relative to said body by said motor and adapted to carry an element for abrading or polishing a work surface;
- a shroud carried by said body and disposed about said head;
- means for delivering water through the interior of said shroud and then through passage means in said head to said work surface;
- sais shroud being constructed to confine a suction induced flow of air, water and abraded particles from the location of said work surface; and
- two generally concentric and generally annular seals between the shroud and head confining the flow of water to the head between said seals, and confining said flow of air, water and abraded particles radially outwardly of an outer one of said seals.

2. A portable abrading or polishing tool as recited in claim 1, including a third generally annular seal carried by said shroud for engaging the work surface about the head.

3. A portable abrading or polishing tool as recited in claim 2, in which said motor is an air motor, said tool including an aspirator energized by air discharged from said motor to induce said flow of air, water and abraded particles from the work surface.

4. A portable abrading or polishing tool, comprising:
- a tool body to be held and manipulated by a user;
- a rotary motor carried by said body;
- a head movable relative to said body and adapted to carry an element for abrading or polishing a work surface;

an orbital drive connection between the motor and head for driving the head and a carried abrading element orbitally about an axis relative to said body to abrade or polish a work surface;

a shroud carried by said body and disposed about said head;

means carried by said body for delivering water through the interior of said shroud and then through passage means formed in the head to the work surface;

said shroud being constructed to confine a suction induced flow of air, water and abraded particles from the location of said work surface; and two spaced generally annular seals disposed generally about said axis and confining the water flow between said shroud and said head in isolation from said flow of air, water and abraded particles from the work surface.

5. A portable abrading or polishing tool as recited in claim 4, including a third seal carried by said shroud and engageable with the work surface about said head.

6. A portable abrading or polishing tool as recited in claim 5, in which said passage means in the head include a series of openings in the head receiving water from between said two generally annular seals and conducting the water to the work surface.

7. A portable abrading or polishing tool, comprising:

a tool body to be held and manipulated by a user;

a rotary motor carried by said body and having a part driven rotatively about an axis;

a head which is driven about said axis relative to said body by said motor and is adapted to carry an element for abrading or polishing a work surface and which contains passage means for delivering water to said surface through the head;

a member carried by said body near said head and relative to which said head moves when driven by the motor;

means for delivering water to a location between said head and said member communicating with said passage means for delivery of water from said location to said passage means; and two seals extending about said axis between said member and said relatively movable head and which are radially inwardly and radially outwardly of said passage means and prevent escape of water between said member and head.

8. A portable abrading or polishing tool, comprising:

a tool body to be held and manipulated by a user;

a rotary motor carried by said body and having a part driven rotatively about an axis;

a head which is driven about said axis relative to said body by said motor and is adapted to carry an element for abrading or polishing a work surface and which contains passage means for delivering water to said surface through the head;

a member carried by said body near said head and relative to which said head moves when driven by the motor;

means for delivering water to a location between said head and said member communicating with said passage means for delivery of water from said location to said passage means; and means forming a seal extending about said axis between said member and said relatively movable head and preventing escape of water therebetween;

said means forming a seal including two generally concentric seal rings disposed generally about said axis between said member and said head, one of said rings forming a seal radially inwardly of said passage means, the other of said rings forming a seal radially outwardly of said passage means.

9. A portable abrading or polishing tool, comprising:

a tool body to be held and manipulated by a user;

a rotary motor carried by said body and having a part driven rotatively about an axis;

a head which is driven orbitally about said axis relative to said body by said motor and is adapted to carry an element for abrading or polishing a work surface and which contains passage means for delivering water to said surface through the head;

a member carried by said body near said head and relative to which said head moves when driven by the motor;

means for delivering water to a location between said head and said member communicating with said passage means for delivery of water from said location to said passage means; and means forming a seal extending about said axis between said member and said relatively movable head and preventing escape of water therebetween;

said passage means including a series of passages in the head spaced circularly apart about said axis, said means forming a seal including a first seal ring disposed between said member and said head at a location radially outwardly of said passages in the head, and a second seal ring between said member and said head radially inwardly of said passages.

10. A portable abrading or polishing tool, comprising:

a tool body to be held and manipulated by a user;

a motor carried by said body;

a head which is driven about an axis relative to said body by said motor and is adapted to carry an element for abrading or polishing a work surface and which contains passage means for delivering water to said work surface through the head;

a member carried by said body near said head and relative to which said head moves when driven by the motor;

means for delivering water to a space between said head and said member communicating with said passage means for delivery of water from said space to said passage means;

said member and said head having relatively movable axially opposed surfaces about said passage means; and a seal element interposed axially between said relatively movable axially opposed surfaces of said member and said head about said passage means to prevent escape of water between the member and head.

11. A portable abrading or polishing tool, comprising:

a tool body to be held and manipulated by a user;

a motor carried by said body;

a head which is driven about an axis relative to said body by said motor and is adapted to carry an element for abrading or polishing a work surface and which contains a plurality of passages spaced about said axis for delivering water to said work surface through the head;

a member carried by said body near said head and relative to which said head moves when driven by the motor;

means for delivering water to a space axially between said head and said member communicating with said passages for delivery of water from said space to said passages; and a seal element extending about said axis and about said plurality of passages at a location axially between said member and said relatively movable head and forming a seal preventing escape of water therebetween.

12. A portable sander comprising:

a tool body to be held and manipulated by a user;

a motor carried by said body;

a head movable about an axis relative to said body by said motor and having an undersurface adapted to carry a sheet of sandpaper for abrading a work surface;

said head containing passage means for conducting water downwardly through the interior of said head to the work surface;

means for delivering water to said passage means for flow therethrough to the work surface; and a shroud carried by said body about said head for conducting a suction induced flow of air, water and abraded particles from said work surface in isolation from the incoming water flowing through said passage means in the head.

13. A portable sander as recited in claim 12, in which said means for delivering water to said passage means include seal means at the upper side of said head for isolating the flow of water to said head from said flow of air, water and particles leaving the work surface through the shroud.

14. A portable sander as recited in claim 12, including sealing means on said shroud engageable with the work surface about said head to confine said flow of air, water and abraded particles.

15. A portable sander as recited in claim 12, in which said means for delivering water to said passage means deliver the water through the interior of said shroud to said passage means.

16. A portable sander as recited in claim 15, including seal means between said shroud and said head for delivering water to said passage means in the head in isolation from said flow of air, water and abraded particles from the work surface.

17. A portable sander as recited in claim 16, including sealing means on said shroud engageable with the work surface about said head to confine said flow of air, water and abraded particles.

18. A portable sander as recited in claim 12, in which said motor is an air motor, said tool including an aspirator energized by air discharged from said motor to induce said flow of air, water and abraded particles from the work surface.

19. A portable sander as recited in claim 12, including an orbital drive connection between the motor and head for moving the head and a carried sheet of sandpaper orbitally to abrade the work surface.

* * * * *